US011036248B1

(12) United States Patent
Podzemny

(10) Patent No.: US 11,036,248 B1
(45) Date of Patent: Jun. 15, 2021

(54) METHOD OF FORMING A SEMICONDUCTOR DEVICE AND CIRCUIT

(71) Applicant: SEMICONDUCTOR COMPONENTS INDUSTRIES, LLC, Phoenix, AZ (US)

(72) Inventor: Martin Podzemny, Lesna (CZ)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 16/806,246

(22) Filed: Mar. 2, 2020

(51) Int. Cl.

| | |
|---|---|
| ***G05F 1/575*** | (2006.01) |
| ***G05F 1/46*** | (2006.01) |
| ***G05G 1/56*** | (2008.04) |
| ***G05F 1/10*** | (2006.01) |

(52) U.S. Cl.
CPC ..... *G05F 1/575* (2013.01); *G05F 1/10* (2013.01); *G05F 1/46* (2013.01); *G05G 1/56* (2013.01)

(58) Field of Classification Search
CPC ... G05F 1/575; G05F 1/56; G05F 1/10; G05F 1/46; G05F 1/563
See application file for complete search history.

(56) References Cited

U.S. PATENT DOCUMENTS

| | | | | |
|---|---|---|---|---|
| 5,686,820 | A * | 11/1997 | Riggio, Jr. | G05F 1/575 323/273 |
| 10,073,477 | B2 * | 9/2018 | Chu | G05F 1/463 |
| 10,560,027 | B2 | 2/2020 | Tao et al. | |
| 2006/0170460 | A1 * | 8/2006 | Kawasumi | G11C 7/065 327/52 |
| 2008/0174289 | A1 | 7/2008 | Gurcan et al. | |

OTHER PUBLICATIONS

Prakash Harikumar, "Low-Voltage Analog-to-Digital Converters and Mixed-Signal Interfaces," Linkoeping Studies in Science and Technology Dissertations, No. 1728, Division of Integrated Circuits and Systems Department of Electrical Engineering (ISY) Linkoeping University, ISBN 978-91-7685-890-5, ISSN 0345-7524, Printed by LiU-Tryck, Linkoeping, Sweden, 20152015, 149 pages.

* cited by examiner

*Primary Examiner* — Jung Kim
(74) *Attorney, Agent, or Firm* — Robert F. Hightower

(57) ABSTRACT

A voltage regulator circuit may include a first loop that forms a reference signal that substantially does not vary in response to the output voltage, the reference circuit may also be configured to form a control signal that is representative of changes in the reference signal. The voltage regulator circuit may also include a second loop configured to form a value of a control electrode of an output transistor according to the control signal and wherein the output circuit is configured to change a value of the control electrode according to a difference between the output voltage and the reference signal.

15 Claims, 4 Drawing Sheets

METHOD OF FORMING A SEMICONDUCTOR DEVICE AND CIRCUIT

BACKGROUND

The present invention relates, in general, to electronics, and more particularly, to semiconductors, structures thereof, and methods of forming semiconductor devices and circuits therefor.

In the past, various methods and structures were utilized to form on chip voltage regulator circuits that would supply a regulated voltage and a load current to a load that was on the same chip as the voltage regulator circuit. The load often included large numbers of logic circuits that switched states and often switched states synchronously with a clock signal. The switching caused average currents to quickly vary from units of microamps to tens of milliamps in a very short period of time. The large number of switching circuits generated noise and perturbations in the supply voltage. Thus, a large bypass capacitor was often connected to the output voltage of the regulator circuit so that the output voltage would not droop during switching of the logic circuits. Because the bypass capacitor had a large value, it generally was not on the chip with the voltage regulator circuit, which increased system costs.

Accordingly, it is desirable to have a voltage regulator circuit that can supply a regulated voltage and current to a load and/or that can operate with an on-chip output capacitor.

Figure 1:
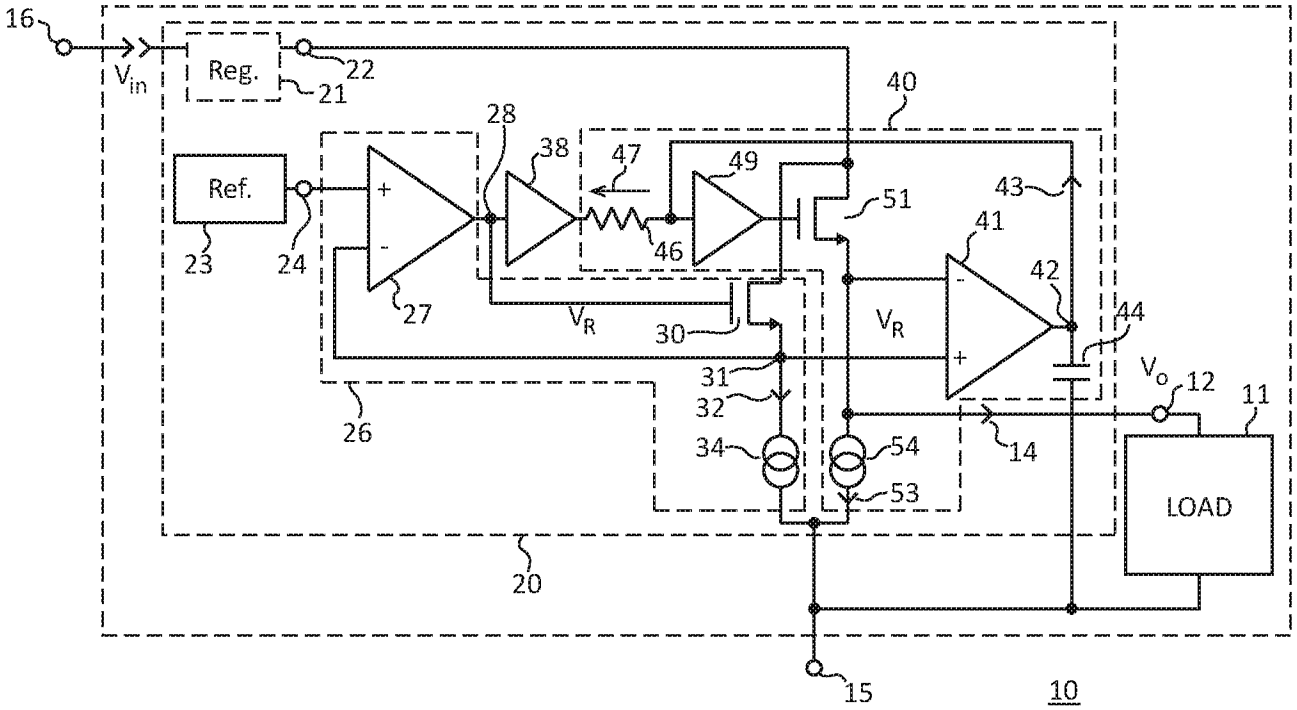
FIG. 1 schematically illustrates an example of a portion of an embodiment of a system that includes a voltage regulator circuit in accordance with the present invention.

For simplicity and clarity of the illustration(s), elements in the figures are not necessarily to scale, some of the elements may be exaggerated for illustrative purposes, and the same reference numbers in different figures denote the same elements, unless stated otherwise. Additionally, descriptions and details of well-known steps and elements may be omitted for simplicity of the description. As used herein current carrying element or current carrying electrode means an element of a device that carries current through the device such as a source or a drain of an MOS transistor or an emitter or a collector of a bipolar transistor or a cathode or anode of a diode, and a control element or control electrode means an element of the device that controls current through the device such as a gate of an MOS transistor or a base of a bipolar transistor. Additionally, one current carrying element may carry current in one direction through a device, such as carry current entering the device, and a second current carrying element may carry current in an opposite direction through the device, such as carry current leaving the device. Although the devices may be explained herein as certain N-channel or P-channel devices, or certain N-type or P-type doped regions, a person of ordinary skill in the art will appreciate that complementary devices are also possible in accordance with the present invention. One of ordinary skill in the art understands that the conductivity type refers to the mechanism through which conduction occurs such as through conduction of holes or electrons, therefore, that conductivity type does not refer to the doping concentration but the doping type, such as P-type or N-type. It will be appreciated by those skilled in the art that the words during, while, and when as used herein relating to circuit operation are not exact terms that mean an action takes place instantly upon an initiating action but that there may be some small but reasonable delay(s), such as various propagation delays, between the reaction that is initiated by the initial action. Additionally, the term while means that a certain action occurs at least within some portion of a duration of the initiating action. The use of the word approximately or substantially means that a value of an element has a parameter that is expected to be close to a stated value or position. However, as is well known in the art there are always minor variances that prevent the values or positions from being exactly as stated. It is well established in the art that variances of up to at least ten percent (10%) (and up to twenty percent (20%) for some elements including semiconductor doping concentrations) are reasonable variances from the ideal goal of exactly as described. When used in reference to a state of a signal, the term "asserted" means an active state of the signal and the term "negated" means an inactive state of the signal. The actual voltage value or logic state (such as a "1" or a "0") of the signal depends on whether positive or negative logic is used. Thus, asserted can be either a high voltage or a high logic or a low voltage or low logic depending on whether positive or negative logic is used and negated may be either a low voltage or low state or a high voltage or high logic depending on whether positive or negative logic is used. Herein, a positive logic convention is used, but those skilled in the art understand that a negative logic convention could also be used. The terms first, second, third and the like in the claims or/and in the Detailed Description, as used in a portion of a name of an element, are used for distinguishing between similar elements and not necessarily for describing a sequence either temporally, spatially, in ranking or in any other manner. It is to be understood that the terms so used are interchangeable under appropriate circumstances and that the embodiments described herein are capable of operation in other sequences than described or illustrated herein. Reference to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but in some cases it may. Furthermore, the particular features, structures or characteristics may be combined in any suitable manner, as would be apparent to one of ordinary skill in the art, in one or more embodiments.

The embodiments illustrated and described hereinafter may have embodiments and/or may be practiced in the absence of any element which is not specifically disclosed herein.

DETAILED DESCRIPTION

FIG. 1 schematically illustrates an example of a portion of an embodiment of a system 10 that includes a voltage regulator circuit 20 to supply an output voltage $V_O$ to a load 11. In an embodiment, circuit 20 and load 11 may be formed together on a single semiconductor substrate or chip. Voltage regulator circuit 20 receives an input voltage ($V_{IN}$) on an input 16 and supplies regulated output voltage $V_O$ on an output 12 to load 11. System 10 receives the input voltage ($V_{IN}$) between input 16 and a common return terminal 15. Terminal 15 typically is connected to a common return voltage such as a ground potential or other common return voltage.

Circuit 20 includes a control circuit 26, an output circuit 40, and a reference generator circuit 23 that forms a reference voltage 24 on an output of circuit 23. Circuit 23 may have an embodiment that may include a bandgap reference circuit or other well-known circuits to form voltage 24. In some embodiments, circuit 20 may also include an optional step-down regulator 21 that receives the input voltage ($V_{IN}$) and forms a more stable internal operating voltage 22 on an output of regulator 21. In some embodiments, regulator 21 may be omitted and the input voltage ($V_{IN}$) may be connected to form internal operating voltage 22. The internal circuits of control circuit 26 and of output circuit 40 and circuit 23 generally operate from voltage 22, such as for example between voltage 22 and terminal 15.

An embodiment of circuit 26 includes an operational amplifier 27, a reference transistor 30, and a bias current source 34. Output circuit 40 includes a transconductance amplifier 41, an output transistor 51, a bias current source 54, a first buffer 38, a second buffer 49, a resistor 46, and a compensation capacitor 44. The output of transistor 51 supplies a load current 14 to load 11 and forms the value of the output voltage ($V_O$) on output 12. In an embodiment, buffer 48 may be omitted. For example, amplifier 27 may include a buffered output. An embodiment may include that capacitor 44 may be omitted and frequency compensation may be formed by a circuit within amplifier 41.

As will be seen further hereinafter, an embodiment of circuit 20 forms a first control loop that controls voltage $V_R$ to be substantially independent of changes in voltage $V_O$. In an embodiment, circuit 20 may be configured to control voltage $V_R$ so that $V_R$ substantially does not change in response to changes in voltage $V_O$. An embodiment of circuit 20 may be configured to maintain voltage $V_R$ to be substantially equal to voltage 24. Circuit 26 receives voltage 24 from circuit 23 and forms a reference voltage ($V_R$) at a node 31 such that voltage $V_R$ is substantially equal to voltage 24. Those skilled in the art will appreciate that amplifier 27 controls the gate voltage of transistor 30 to maintain voltage $V_R$ to be substantially equal to voltage 24. An embodiment of circuit 26 does not receive the output voltage $V_O$ nor any feedback signals that are representative of either voltage $V_O$ or of current 14. In an embodiment, circuit 26 controls the value of voltage $V_R$ to be substantially independent of changes in output voltage $V_O$ and substantially independent of changes in current 14. Thus, voltage $V_R$ is substantially constant and has substantially no variations due to changes in $V_O$. However, those skilled in the art will appreciate that other influences such as a change in the input voltage ($V_{IN}$) or changes in the common reference voltage on terminal 15 may have some slight effect and slightly change the value of voltage $V_R$. Additionally, those skilled in the art will appreciate that a rapid step change in $V_O$ may be coupled through some indirect means, such a capacitive coupling through the semiconductor substrate on which circuit 26 is formed, and cause a slight change in the value of $V_R$., or may be caused by capacitive coupling between the inputs of amplifier 41. However, those changes do not substantially change the value of $V_R$, thus, $V_O$ does not substantially change in response to changes in $V_O$. If the value of voltage $V_R$ does change, amplifier 27 adjusts the value of a control signal 28 on the output of amplifier 27 and controls the gate voltage of transistor 30 to maintain voltage $V_R$ to be substantially equal to voltage 24. The control loop of circuit 20 has a very slow response time and very accurately control the value of $V_R$.

As will be seen further hereinafter, an embodiment of circuit 40 forms a second control loop that controls voltage $V_O$ to be substantially equal to voltage $V_R$. The second control loop has a very fast response time and only adjusts $V_O$ in response to changes in $V_O$. In an embodiment, circuit 40 does not have a high gain, thus, it can be fast. An embodiment of circuit 40 may be configured to control the gate voltage of transistor 51 to be substantially the same as the gate voltage for transistor 30, for example under the condition of current 14 being substantially zero. Thus, circuit 40 may be configured to form a gate voltage for transistor 51 that is substantially the same as the value of signal 28. Buffers 38 and 49 may have an embodiment of unity gain buffers. Under the condition that the value of load current 14 is substantially zero, the voltage on the output of buffer 49 is substantially the same as the value of signal 28. Thus, transistor 51 is controlled to form voltage $V_O$ to be substantially the same as the value of voltage $V_R$. Under such conditions, the inputs of amplifier 41 are substantially equal and the value of an output current 43 of amplifier 41 is substantially zero, such that amplifier 41 does not affect the operation of transistor 51.

In operation of an embodiment, current 14 flows through transistor 51 to load 11. Amplifier 41 forms current 43 so that transistor 51 forms $V_O$ substantially equal to $V_R$. If load 11 changes, it will cause a change in current 14. A change in the value of current 14 may cause the value of output voltage $V_O$ to change. An embodiment of circuit 40 may be configured to control transistor 51 according to a difference between voltage $V_O$ and voltage $V_R$ (the difference also referred to herein as "Delta"). In an embodiment, circuit 40 may be configured to form an adjust signal that varies in response to the Delta and to change the gate voltage of transistor 51 according to the value of the adjust signal. In an embodiment, the adjust signal may be current 43 that flows out of output 42 of amplifier 41 into buffer 38 or alternately may be a value of an adjust voltage 47 formed across resistor 46 by current 43. Buffer 38 prevents current 43 from affecting amplifier 27 or signal 28. Buffer 49 prevents the capacitance of transistor 51 from substantially affecting the voltage formed at the input of buffer 49.

In an embodiment of the Vgs of transistor 51 can be expressed by:

$$V_{GS}(51)=V_{GS}(30)+(V47)+V_O-V_R$$

Where $V_{GS}(51)$=gate-to-source voltage of transistor 51, $V_{GS}(30)$=gate-to-source voltage of transistor 30, and V47=voltage 47 (across resistor 46).

Also, the gain (A) of the second control loop can be expressed by:

$$A_V=Gm(R46)$$

Where $A_V$=voltage gain,

Gm=the current gain of amplifier 41, and

R46=the resistance of resistor 46.

Assume that load 11 is in operation and requires an increased value of current 14 which correspondingly decreases the value of $V_O$ and forms the Delta. Amplifier 41 increases current 43, flowing out of output 42, such that the increased value of current 43 is representative of the Delta. The increased value of current 43 flows through resistor 46 and increases the value of voltage 47 that is dropped across resistor 46. Consequently, the input of buffer 49 is decreased. The gate voltage of transistor 51, thus the $V_{GS}$, is decreased to in order to adjust voltage $V_O$ to be substantially equal to $V_R$.

To assist transistor 51 supplying a large value for current 14, the active area of transistor 51 is larger than the active area of transistor 30 by a value N. Current sources 34 and 54 form respective bias currents 32 and 53 for respective transistors 30 and 51. In order to maintain balance of bias currents 32 and 53 through sources 34 and 54, source 54 forms current 53 larger than current 32 by the same ratio N.

Capacitor 44 is connected to output 42 of amplifier. Capacitor 44 is a compensation capacitor that forms the dominant pole for circuit 20. Those skilled in the art will appreciate that capacitor 44 may be connected to a different point as long as the loop has frequency compensation to provide loop stability.

In order to assist in providing the hereinbefore described operation, the drain of transistor 51 is commonly coupled to a drain of transistor 30 and to the output of circuit 21. A source of transistor 30 is commonly coupled to a non-inverting input of amplifier 41, a first terminal of source 34, and to an inverting input of amplifier 27. A non-inverting input of amplifier 27 is connected to receive voltage 24 from circuit 23. The output of amplifier 27 is commonly coupled to an input of buffer 38 and to a gate of transistor 30. An output of buffer 38 is connected to a first terminal of resistor 46. A second terminal of resistor 46 is commonly coupled to an input of buffer 49, to output 42 of amplifier 41, and to a first terminal of capacitor 44. A second terminal of capacitor 44 is commonly connected to terminal 15, a second terminal of source 34, a first terminal of source 54, and to a return of load 11. A second terminal of source 54 is commonly connected to output 12, to an input of load 11, to an inverting input of amplifier 41, and to a source of transistor 51.

Figure 2:
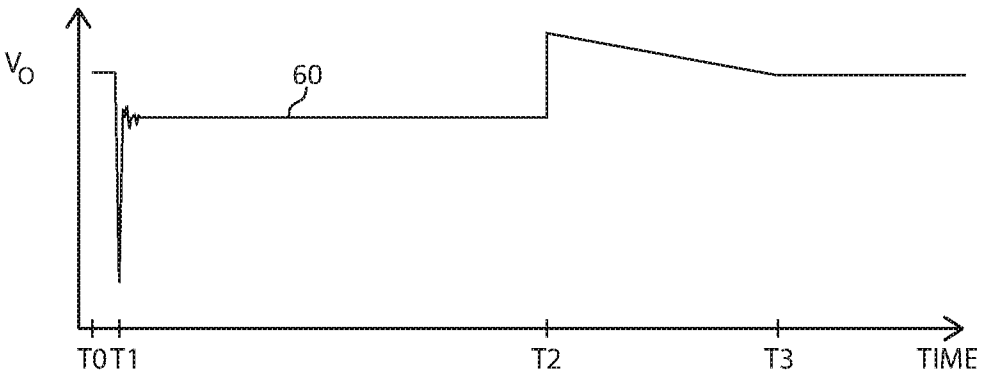
FIG. 2 is a graph having a plot that illustrates an example of an embodiment of at least one signal that may be formed during the operation of an embodiment of the circuit of FIG. 1 in accordance with the present invention.

FIG. 2 is a graph having a plot that illustrates an example of an embodiment of the output voltage $V_O$ that may be formed during the operation of an embodiment of circuit 20. The abscissa indicates time and the ordinate indicates increasing value of $V_O$. Assume that at a time T0 current 14 is a low value less than approximately one to two micro-amperes and $V_O$ is at the regulated value. At a time T1 current 14 increases to approximately five milli-amperes which causes $V_O$ to decrease. However, since circuit 40 has a fast response time, it adjusts $V_O$ to substantially the regulated value at approximately T1. Due to the voltage gain of the loop formed by circuit 40, $V_O$ may not return to exactly the original value (as shown in FIG. 2). However, the gain of amplifier 41 causes this difference to be very small, typically one-tenth of what the difference would be without circuit 40. At a time T2, current 14 decreases back to the low value which causes $V_O$ to increase. Circuit 20 rapidly regulates $V_O$ to the regulated value by time T3.

Those skilled in the art will appreciate that a change in load 11, thus current 14, attempts to form a difference between $V_O$ and $V_R$. However, the effect on $V_O$ is compensated by the control loop of circuit 40 such that $V_R-V_O=(V_{GS}(51)-V_{GS}(39))/(A_V-1)$. In an example embodiment, an increases in current 14 may attempt to change $V_{GS}(51)-V_{GS}(39)$ to be approximately 500 mv. For this example, $A_V$ may have a value of approximately ten (10). Thus, the actual difference ($V_R-V_O$) would be approximately fifty-six (56) mV due to $A_V-1=(10-1)$.

Figure 3:
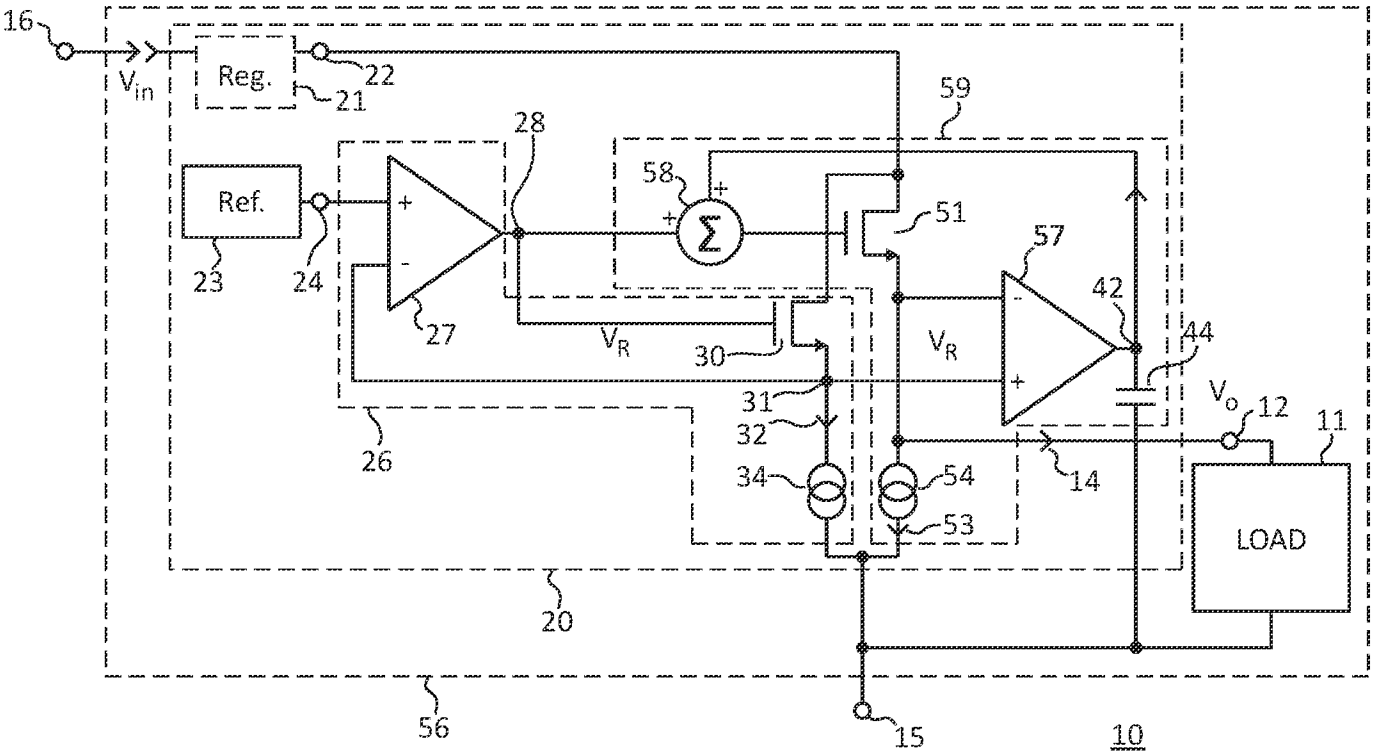
FIG. 3 schematically illustrates an example of a portion of an embodiment of a system that may be an alternate embodiment of the system of FIG. 1 in accordance with the present invention.

FIG. 3 schematically illustrates an example of a portion of an embodiment of a system 56 that may have an embodiment that is an alternate embodiment of system 10 (FIG. 1). System 56 is substantially the same as system 10 except that system 56 includes an output circuit 59 that may have an embodiment that may be an alternate embodiment of circuit 40 (FIG. 1). Circuit 59 is substantially the same as circuit 40 except that circuit 59 replaces amplifier 41 with a voltage amplifier 57, and replaces buffer 38 and resistor 46 with a summing circuit 58.

Those skilled in the art will appreciate that, similarly to circuit 40, circuit 59 is configured to form the adjust signal, for example current 43 or the output of circuit 58, that varies in response to the difference between the output voltage and the reference signal. Circuit 59 is also configured to change a gate voltage of transistor 51 according to the adjust signal.

Figure 4:
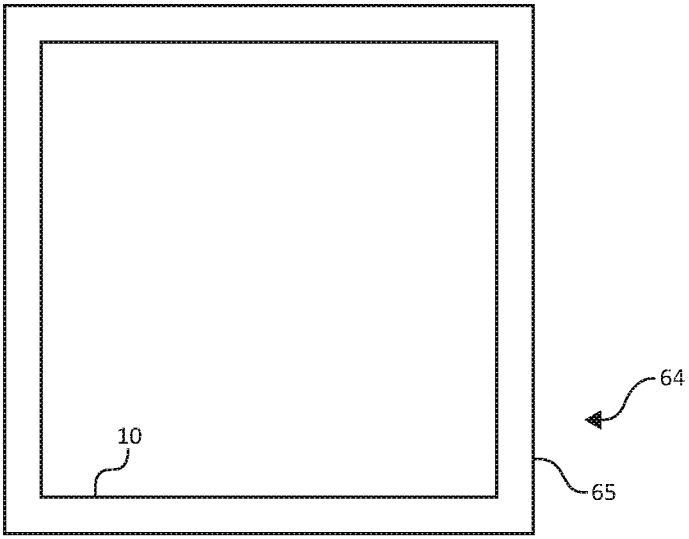
FIG. 4 illustrates an enlarged plan view of a semiconductor device that includes the circuit of FIG. 1 or of FIG. 2 in accordance with the present invention.

FIG. 4 illustrates an enlarged plan view of a portion of an embodiment of a semiconductor device or integrated circuit 64 that is formed on a semiconductor die 65. In an embodiment, circuit 20 and load 11, or alternately system 10 or system 56, may be formed on die 65. Die 65 may also include other circuits that are not shown in FIG. 4 for simplicity of the drawing.

From all the foregoing, one skilled in the art will appreciate that an embodiment of a voltage circuit may be configured to form an output voltage for a load, the voltage circuit may comprise:

a control circuit, for example circuit 26, configured to form a reference voltage, for example voltage $V_R$, wherein the control circuit does not receive a signal that is representative of either of the output voltage, for example $V_O$, or an output current, for example current 14, supplied to the load by the voltage circuit;

an output transistor, for example transistor 51, that conducts the output current and forms the output voltage;

a transconductance amplifier, for example amplifier 41, that forms an output signal, for example signal 42, that varies in response to a difference between the output voltage and the reference voltage; and an output circuit, for example circuit 40, having a resistor, for example resistor 46, coupled in series between the control circuit and the output transistor to form a first voltage for a gate voltage for the output transistor, wherein the resistor also receives the output signal and changes the first voltage according to the output signal.

An embodiment may include that the transconductance amplifier may receive a first signal, for example signal from output 12, that is representative of the output voltage and receives a second signal, for example the reference signal, that is representative of the reference voltage and responsively forms the output signal.

An embodiment of the transconductance amplifier may have an inverting input coupled to receive the output voltage and a non-inverting input coupled to receive the reference voltage.

In an embodiment, the output transistor may include a drain coupled to receive an input voltage, a source coupled to supply the output current to the load, and a gate coupled to receive the gate voltage from the output circuit.

The voltage circuit may have an embodiment wherein the resistor has a first terminal coupled to receive a control voltage from the control circuit, the resistor having a second terminal that receives a signal representative of the output signal.

An embodiment may include that the output circuit includes a first buffer, for example buffer 49, that is coupled to the second terminal of the resistor and applies the gate voltage to the output transistor.

In an embodiment, the output circuit may include a second buffer, for example buffer 38, that receives the control voltage from the control circuit and applies a representative signal to the second terminal of the resistor.

The voltage circuit may also have an embodiment wherein the output circuit includes a second buffer that receives the control voltage, for example signal 28, from the control circuit and has an output coupled to the first terminal of the resistor, the second terminal of the resistor commonly coupled to an input of the first buffer and to receive the output signal from the transconductance amplifier.

Another embodiment may include an operational amplifier, for example amplifier 27, that forms the control voltage that controls a value of the reference voltage and wherein the second buffer has an input coupled to an output of the operational amplifier to receive the control voltage.

Another embodiment may further include a frequency compensation capacitor coupled to an output of the transconductance amplifier.

Those skilled in the art will also appreciate that an embodiment of a method of forming a voltage circuit for supplying an output voltage and an output current to a load may comprise:

coupling an output transistor, for example transistor 51, to conduct the output current to the load and to form the output voltage;

configuring a control circuit, for example circuit 23 or 26, to form a reference signal, for example $V_R$, wherein the control circuit does not receive a signal that is representative of the output voltage; and configuring an output circuit, for example circuit 40, to form an adjust signal, for example signal 43 or 47, that varies in response to a difference between the output voltage and the reference signal, and to change a gate voltage of the output transistor according to the adjust signal.

The method may have an embodiment that includes coupling an operational amplifier, for example amplifier 27, to receive the reference signal and to receive a reference voltage, for example voltage from circuit 23, from a reference generation circuit, the operational amplifier may be configured to control a reference transistor, for example transistor 30, to form the reference signal.

An embodiment may include configuring the output circuit to form a first signal, for example output of buffer 38, that is substantially constant and substantially does not vary in response to the output voltage, and to combine the first signal with the adjust signal.

Another embodiment may further include configuring the output circuit to sum the adjust signal and the first signal.

The method may also include coupling a transconductance amplifier to form an output current that is representative of the difference between the output voltage and the reference signal, and coupling a resistor, for example 46, to receive the output current and change the gate voltage in response to the output current.

Those skilled in the art will also appreciate that an embodiment of a semiconductor device having a regulator circuit for forming an output voltage may comprising:

a reference circuit, for example circuit 23 or 26, configured to form a reference signal, for example $V_R$, that substantially does not vary in response to the output voltage, the reference circuit also configured to form a control signal, for example output 28, that is representative of changes in the reference signal;

an output transistor configured to conduct an output current to a load and to control the output voltage; and an output circuit, for example circuit 40, configured to form a value of a control electrode of the output transistor according to the control signal and wherein the output circuit is configured to change a value of the control electrode according to a difference between the output voltage and the reference signal.

An embodiment may also include that the reference circuit includes an operation amplifier that forms a control signal that is representative of changes in the reference signal, the reference circuit including a transistor wherein the reference circuit controls a gate voltage of the transistor according to the control signal.

In an embodiment, the control circuit may include a transconductance amplifier coupled to form an adjust signal according to a difference between the output voltage and the reference signal.

An embodiment may include that the reference circuit does not receive a signal that is representative of the output voltage or the output current.

In an embodiment, the regulator circuit and the load are formed as semiconductor devices on a single semiconductor substrate.

In view of all of the above, it is evident that a novel device and method is disclosed. Included, among other features, is forming a first control loop that forms a reference voltage that is not substantially affected by changes in the output voltage. This facilitates forming the first control loop to have a large gain and low bandwidth and wherein the value of the reference voltage does not substantially change. Also included is forming a second control loop that only adjust $V_O$ in response to changes in $V_O$.

While the subject matter of the descriptions are described with specific preferred embodiments and example embodiments, the foregoing drawings and descriptions thereof depict only typical and non-limiting examples of embodiments of the subject matter and are not therefore to be considered to be limiting of its scope, it is evident that many alternatives and variations will be apparent to those skilled in the art. For example, the non-inverting input of amplifier 41 may be connected to receive the voltage 24 from circuit 23 instead of to node 31. Also, buffer 38 may be omitted if amplifier 27 has a buffered output.

As the claims hereinafter reflect, inventive aspects may lie in less than all features of a single foregoing disclosed embodiment. Thus, the hereinafter expressed claims are hereby expressly incorporated into this Detailed Description of the Drawings, with each claim standing on its own as a separate embodiment of an invention. Furthermore, while some embodiments described herein include some but not other features included in other embodiments, combinations of features of different embodiments are meant to be within the scope of the invention, and form different embodiments, as would be understood by those skilled in the art.

The invention claimed is:

1. A voltage circuit to form an output voltage for a load, the voltage circuit comprising:

a control circuit configured to form a reference voltage wherein the control circuit does not receive a signal that is representative of either of the output voltage or an output current supplied to the load by the voltage circuit;

an output transistor that conducts the output current and forms the output voltage;

a transconductance amplifier that forms an output signal that varies in response to a difference between the output voltage and the reference voltage; and an output circuit having a resistor coupled in series between the control circuit and the output transistor to form a first voltage for a gate voltage for the output transistor, wherein the resistor also receives the output signal and changes the first voltage according to the output signal.

2. The voltage circuit of claim 1 wherein the transconductance amplifier receives a first signal that is representative of the output voltage and receives a second signal that is representative of the reference voltage and responsively forms the output signal.

3. The voltage circuit of claim 1 wherein the transconductance amplifier has an inverting input coupled to receive the output voltage and a non-inverting input coupled to receive the reference voltage.

4. The voltage circuit of claim 1 wherein the output transistor has a drain coupled to receive an input voltage, a source coupled to supply the output current to the load, and a gate coupled to receive the gate voltage from the output circuit.

5. The voltage circuit of claim 1 wherein the resistor has a first terminal coupled to receive a control voltage from the control circuit, the resistor having a second terminal that receives a signal representative of the output signal.

6. The voltage circuit of claim 5 wherein the output circuit includes a first buffer that is coupled to the second terminal of the resistor and applies the gate voltage to the output transistor.

7. The voltage circuit of claim 6 wherein the output circuit includes a second buffer that receives the control voltage from the control circuit and applies a representative signal to the first terminal of the resistor.

8. The voltage circuit of claim 6 wherein the output circuit includes a second buffer that receives the control voltage from the control circuit and has an output coupled to the first terminal of the resistor, the second terminal of the resistor commonly coupled to an input of the first buffer and to receive the output signal from the transconductance amplifier.

9. The voltage circuit of claim 8 wherein control circuit includes an operational amplifier that forms the control voltage that controls a value of the reference voltage and wherein the second buffer has an input coupled to an output of the operational amplifier to receive the control voltage.

10. The voltage circuit of claim 1 further including a frequency compensation capacitor coupled to an output of the transconductance amplifier.

11. A semiconductor device having a regulator circuit for forming an output voltage, the regulator circuit comprising:

a reference circuit configured to form a reference signal that substantially does not vary in response to the output voltage, the reference circuit including an operational amplifier configured to form a control signal that is representative of changes in the reference signal, the reference circuit including a transistor wherein the reference circuit controls a gate voltage of the transistor according to the control signal;

an output transistor configured to conduct an output current to a load and to control the output voltage; and an output circuit configured to form an adjust signal that is representative of a difference between the output voltage and the reference signal, the output circuit configured to form a value of a control electrode of the output transistor responsively to the control signal and the adjust signal.

12. The semiconductor device of claim 11 wherein the output circuit includes a transconductance amplifier coupled to form the adjust signal according to the difference between the output voltage and the reference signal.

13. The semiconductor device of claim 11 wherein the reference circuit does not receive a signal that is representative of the output voltage or the output current.

14. The semiconductor device of claim 11 wherein the regulator circuit and the load are formed as semiconductor devices on a single semiconductor substrate.

15. A semiconductor device having a regulator circuit for forming an output voltage, the regulator circuit comprising:

a reference circuit configured to form a reference signal that substantially does not vary in response to the output voltage, the reference circuit also configured to form a control signal that is representative of changes in the reference signal wherein the control signal substantially does not vary in response to the output voltage; and an output circuit configured to form an adjust signal that is representative of a difference between the output voltage and the reference signal, the output circuit configured change a value of the control signal according to a value of the adjust signal, the output circuit configured to control the output voltage responsively to the value of the control signal.

* * * * *